United States Patent [19]

Beck et al.

[11] 4,085,503

[45] Apr. 25, 1978

[54] ELECTRIC DRY SHAVER WITH ADJUSTABLE LONG HAIR TRIMMER

[75] Inventors: William P. Beck, Westchester; Francis L. Carr, Downers Grove; Jerry P. Gronwick, Park Ridge, all of Ill.

[73] Assignee: Sunbeam Corporation, Chicago, Ill.

[21] Appl. No.: 535,949

[22] Filed: Dec. 23, 1974

[51] Int. Cl.[2] ..... B26B 19/10

[52] U.S. Cl. ..... 30/34.1; 30/43.92; 30/201

[58] Field of Search ..... 30/34.1, 43.1, 90, 200, 30/201, 233, 233-235

[56] References Cited

U.S. PATENT DOCUMENTS

| | | | |
|---|---|---|---|
| 2,941,293 | 6/1960 | Mazzoni | 30/201 |
| 3,237,304 | 3/1966 | Merzon | 30/201 |
| 3,290,774 | 12/1966 | Schuessler | 30/34.1 |
| 3,339,276 | 9/1967 | Tolmie | 30/43.1 X |

*Primary Examiner*—Gary L. Smith

*Attorney, Agent, or Firm*—George R. Clark; Neil M. Rose; Clifford A. Dean

[57] ABSTRACT

Electric dry shaver having a shaving head and a trimmer for cutting long hair, the trimmer being equipped with adjustable means to control the height or length to which the trimmer may cut hair. Control means within the shaver are provided to adjust the height of the trimmer guard and to retain it in the selected position.

9 Claims, 10 Drawing Figures

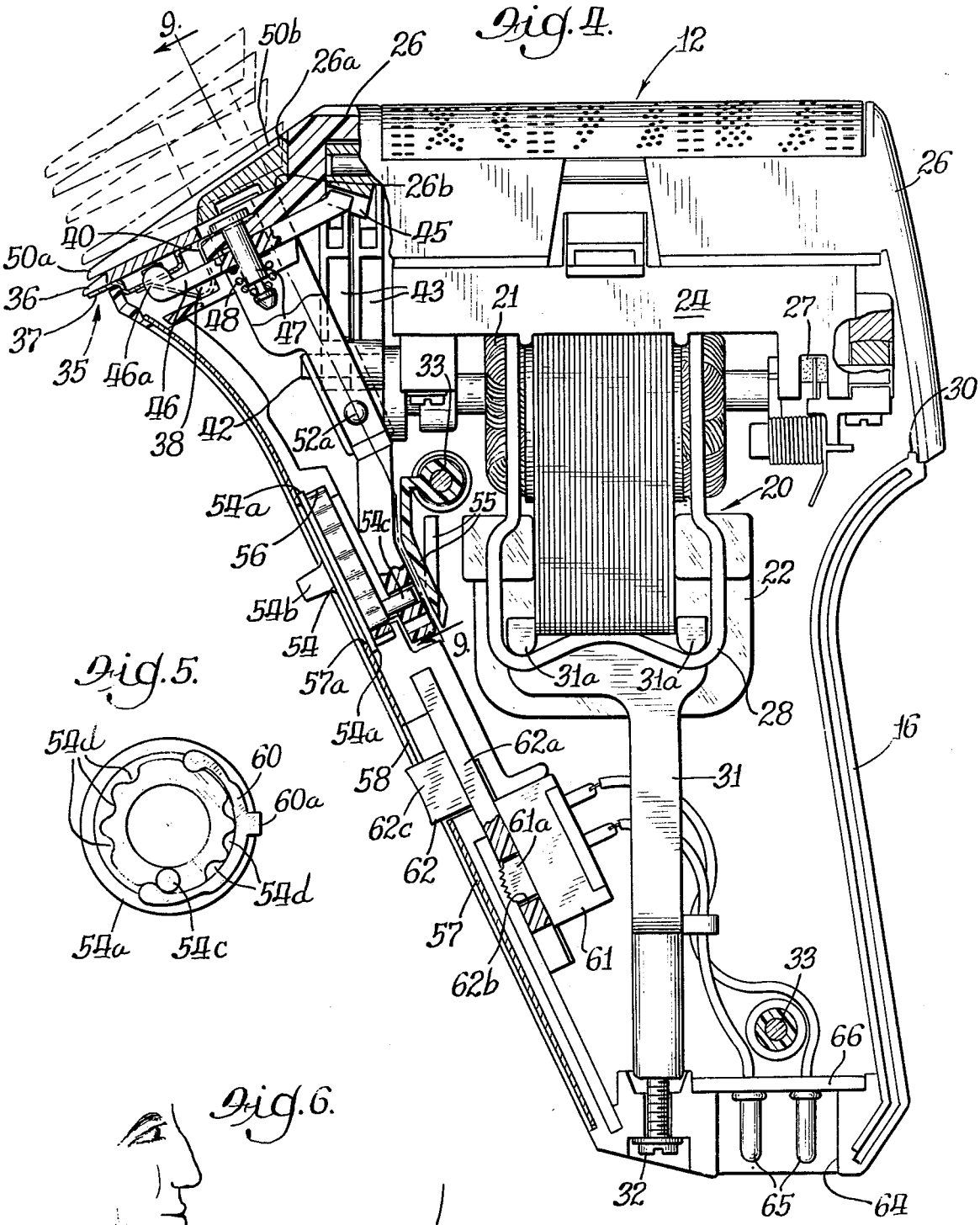
Fig. 4.
9
50b
26a
26
12
26b
40
45
50a
36
37
35
46a
46
38
42
48
47
43
21
24
27
33
52a
30
20
54a
54c
55
56
22
54b
54
9
57a
31a
31a
28
54a
62a
16
58
31
62c
61a
62
57
62b
61
33
66
32
65
64
Fig. 5.
54d
60
60a
54d
54a
54c
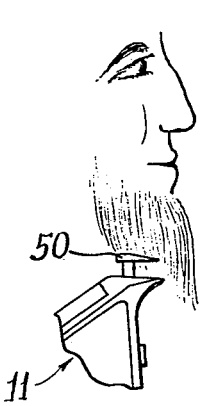
Fig. 6.
50
11
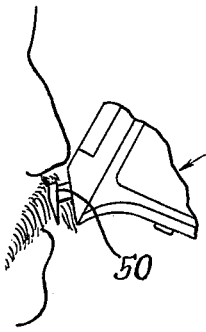
11
50
Fig. 7.

ELECTRIC DRY SHAVER WITH ADJUSTABLE LONG HAIR TRIMMER

BACKGROUND OF THE INVENTION

In the development of the electric dry shaver, it has been found that a shaving head which is attached to give a close comfortable shave is, in general, not suitable for trimming long hairs. If a long hair trimmer is made with a comb thin enough to permit cutting very close to the level of the skin, there is usually a considerable amount of skin irritation as a consequence of skin entering the slots of the trimmer and being cut along with the hair. Accordingly, most satisfactory shaving heads include apertures or slots which are well guarded to prevent the entry of skin into the cutting area and consequently are not effective or useful in cutting long hair. A long piece of hair is not easily directed into one of these guarded apertures or slots as the normal beard stubble may be. This limitation in the shaving head insofar as clipping long hair is concerned has resulted in most electric shavers on the market today including some type of auxiliary trimmer or clipper which is adapted to cut long hair. This adaptation is accomplished by having relatively wide open slots which resemble in general the slots found in the blade sets of a conventional barber hair clipper. An example of an electric shaver having such a long hair trimmer is disclosed in Jackson et al U.S. Pat. No. 3,791,030 which is assigned to the same assignee as the instant application.

The trimmers of the type shown in the above-cited Jackson et al patent are quite effective in trimming sideburns and outlining the hairline around the ears and the like. In addition, such trimmers are useful in picking up long hairs on the neck or elsewhere which have been missed several times in shaving with the conventional shaving head until they have gotten long enough so that they do not readily enter the guarded apertures found in the shaving head. It would be desirable, however, to increase the versatility of the clipper or trimmer found in the normal shaver. The trends in hair styles today result in less frequent haircuts and a need for the individual to trim his hair personally if it is to retain a neat appearance. Thus, with the longer hair styles, a man no longer feels the need to have his hair cut short in a croped, well-shingled manner but may still wish to trim certain portions of the hair which become undesirably long. In addition, it is becoming more common for men to grow beards and mustaches, both of which require various types of trimming or clipping depending on the style. The conventional shaver trimmer has been relatively unsuccessful in coping with these more comprehensive hair clipping tasks requiring many men to feel that they must purchase or use a small hair clipper in addition to their shaver to perform their daily hair grooming tasks. Naturally, it would be more convenient and economic to be able to perform the grooming tasks entirely with the shaver.

One of the major difficulties in using a simple clipper or trimmer to groom oneself is the problem of cutting too deeply when one wishes to do a very slight trimming job. This difficulty is magnifed by the inexperience of one who does not cut or trim hair for a living and the awkwardness of trying to observe and manipulate a clipper with respect to one's own head of hair. Generally, the task is performed in front of a mirror where, of course, the reflection reverses the direction of movement and makes it difficult to coordinate movement of the clipper with the intended objective. For this reason, it is commen in the area of amateur barbering to provide guide means or guards to prevent one from inadvertently cutting the hair too short when only a slight trim is desired. Examples of these guards are found in the patents to Rangus U.S. Pat. No. 3,280,468; Van Osdel U.S. Pat. No. 1,807,811; Buller U.S. Pat. No. 2,034,131; Monyhan U.S. Pat. No. 2,593,168; Suozzi U.S. Pat. No. 3,262,200; Mazzoni U.S. Pat. No. 2,941,293 and Coggins et al U.S. Pat. No. 2,768,438. There is also a considerable amount of prior art relating to trimming guides or guards to be associated with electric shavers. Examples of these patents are Waggoner U.S. Pat. No. 3,008,233; Haislip U.S. Pat. No. 2,715,266 and Caesar U.S. Pat. No. 3,107,423. Although a number of the prior art clipper patents cited above disclose adjustable guides associated with the clippers, perhaps the most pertinent with respect to the instant invention are Mazzoni U.S. Pat. No. 2,941,293 and Suozzi U.S. Pat. No. 3,262,200. It would be desirable, however, to provide a more convenient mounting for the guard and to provide within the housing or casing of the shaver a mechanism for adjusting and for maintaining the position of the guard.

SUMMARY OF THE INVENTION

The present invention involves an electric dry shaver having a shaving head adapted to the cutting or shaving of facial hairs as close as possible to the surface of the skin and having a long hair clipper or trimmer which is adapted to cut long hair either close to the surface or at some selected length. The long hair trimmer is provided with an adjustable guide means or guard which is positioned above the blade set for the clipper and which may be elevated to any one of a number of positions at different heights above the clipper blade set.

The clipper is mounted on the housing of the dry shaver at one end of the shaving head where it does not interfere with the operation when the shaver is used for close shaving while at the same time being readily available for easy manipulation when the user wishes to trim long hairs. The movable guard is supported on a pair of thin post-like members which extend into the shaver housing and are connected to a yoke with the entire assembly mounted for lengthwise movement so that the guard may be raised or lowered. A cam means associated with the control knob for the clipper guard includes detent means which retains the control means as well as the guard in any one of a number of selected positions.

The shaver housing is formed with a decorative panel which carries the indicia positioning of the control means and also serves the structural function of comprising a side plate to retain the control means for the clipper guard in assembled relation to the shaver housing.

The object of the present invention is to provide an improved electric dry shaver having a long hair clipper which is provided with an adjustable guide means or guard.

Another object of the present invention is to provide an improved dry shaver having a shaving head and a long hair clipper, the clipper being provided with a guard which is movable in a direction normal to the plane of the clipper.

A further object of the present invention is to provide a long hair trimmer having an improved guide means which includes a movable guard provided with spaced, wedge-shaped teeth movable to various positions spaced from the blade set of said clipper.

Still another object of the present invention is to provide an improved long hair clipper associated with an electric dry shaver and provided with an adjustable guide means having support and adjustment means mounted within the shaver casing.

Another object of the present invention is to provide an improved long hair clipper having an adjustable guard movable by control means mounted within the shaver housing and utilizing a one-piece detent means which retains the guard and the control means in any one of a number of selected positions.

Further objects and advantages of the present invention will become apparent as the following description proceeds and the features of novelty which characterize the invention will be pointed out with particularlity in the claims annexed to and forming a part of this specification.

BRIEF DESCRIPTION OF THE DRAWINGS

For a better understanding of the present invention, reference may be had to the accompanying drawings in which:

FIG. 4 is a perspective view taken substantially along line 4—4 of FIG. 2 assuming FIG. 2 to show the complete shaver but with the shaving head shown in full lines;

FIG. 5 is a view of the control knob for the clipper guard along with the associated detent means;

FIG. 6 is a sketch illustrating the manner in which the clipper would be used with the guard elevated to trim a beard;

FIG. 7 is another sketch showing the manner of use of the long hair clipper of the invention when trimming a mustache with the clipper guard elevated;

FIG. 4 shows the entire shaver.

Figure 1:
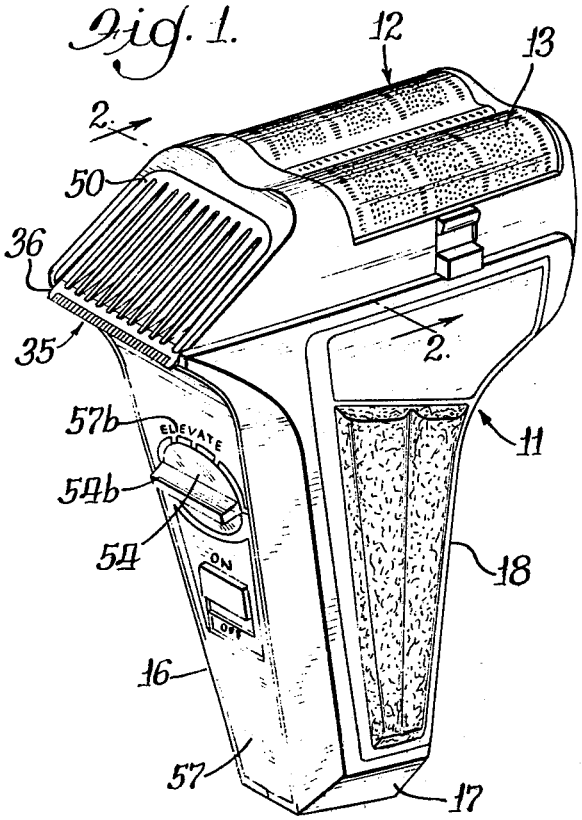
FIG. 1 is a perspective view of an electric dry shaver embodying our invention.

Referring now to the drawings, there is shown in FIG. 1 an electric dry shaver designated generally by reference numeral 11. The dry shaver 11 includes a shaving head 12 of the type which is disclosed in greater detail in the above-cited Jackson et al U.S. Pat. No. 3,791,030. The shaving head 12 includes a perforated comb 13 and oscillating cutters 14 which engage the underside of the comb and, as they are oscillated with respect to the comb, function to trim or cut any hairs or beard stubble which extend through the apertures in the comb 13.

Figure 2:
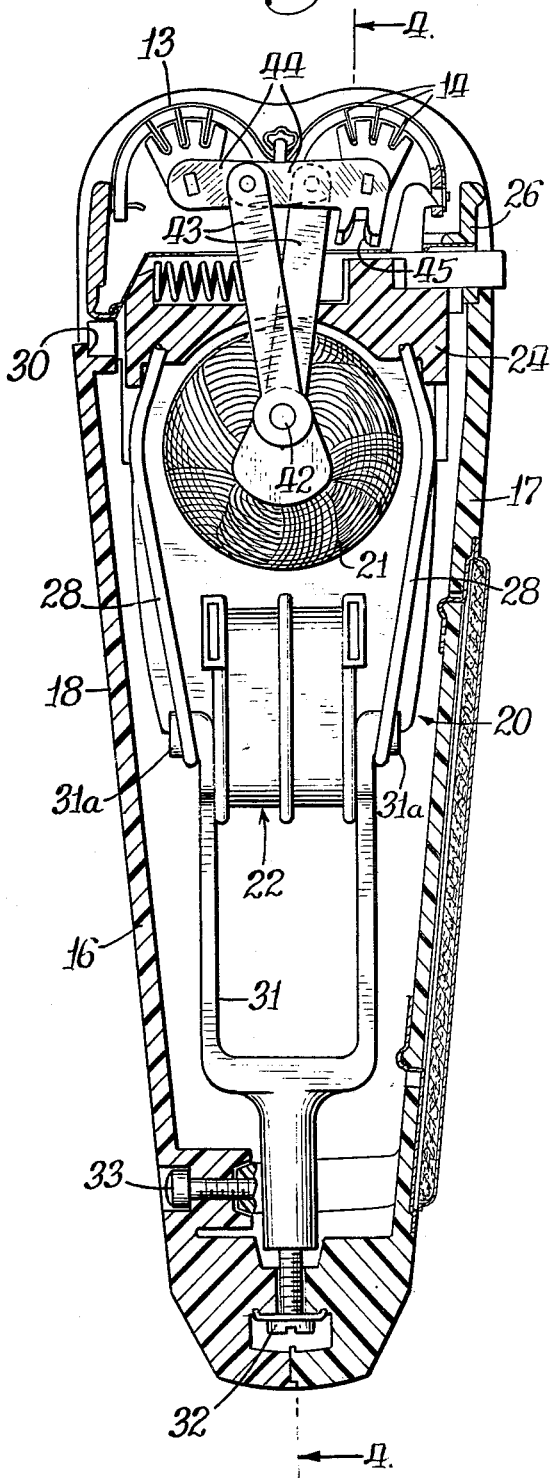
FIG. 2 is an enlarged sectional view taken substantially on line 2—2 of FIG. 1.

The shaver 11 includes a pair of casing halves 16 and 17 which fit together in abutting relationship to form the casing or housing 18. Supported within the casing 18 is an electric motor 20 having a rotary armature 21 and a field 22. The motor 20 includes a supporting block 24 which is in turn secured to a head frame 26. The bearings for the armature 21 and commutator brushes 27 are supported on the block 24. To secure the field 22 to the block 24, there are provided U-shaped bail members 28, as best shown in FIGS. 2 and 4.

The casing or housing 18 defined by the casing halves 16 and 17 includes a top opening 30 in which the supporting block 24 and the head frame 26 are received. In order to secure the head frame 26 in position on the housing 18, there is provided a Y-shaped bracket 31 secured to the motor 20 and extending to the bottom of the housing 18, as is best shown in FIGS. 2 and 4. The bracket 31 has four spaced projections **31*a* which engage the bail members 28, as shown in FIG. 4, and exert a downward force on the motor 20 and accordingly, on the head frame 26. This force is applied by means of a screw 32 which extends through an opening in the bottom of the housing 18 into threaded engagement with the lower end of the bracket 31**.

The head frame 26 engages projections on the upper edge of the housing halves 16 and 17 in order to retain the upper ends of the housing halves in abutting engagement. There are also provided assembly screws 33 which extend through the rear housing half 16 into threaded engagement with the front housing half 17, as shown in FIG. 2.

Figure 8:
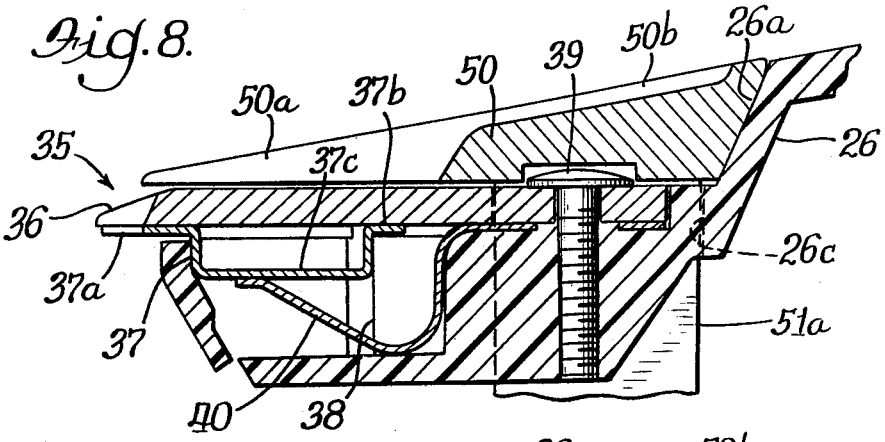
FIG. 8 is an enlarged fragmentary sectional view taken substantially on line 8—8 of FIG. 1.
Figure 9:
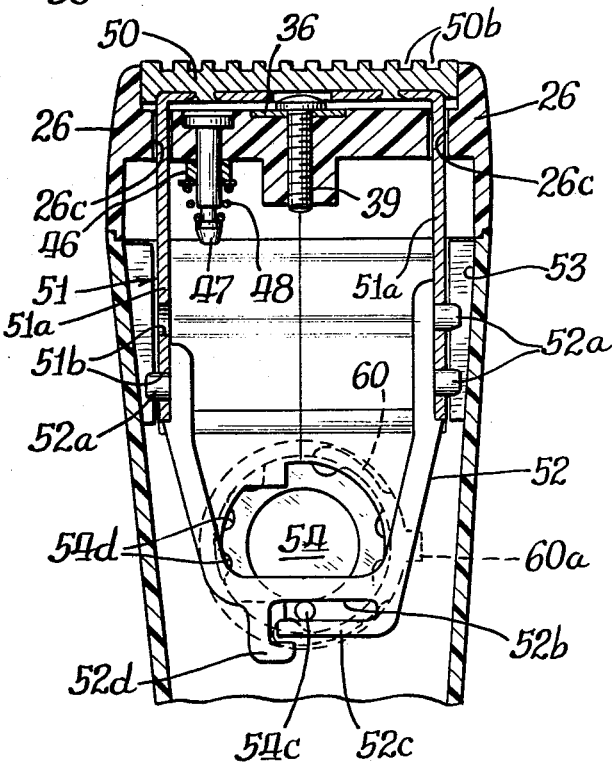
FIG. 9 is a sectional view taken substantially on line 9—9 of FIG. 4 assuming
Figure 10:
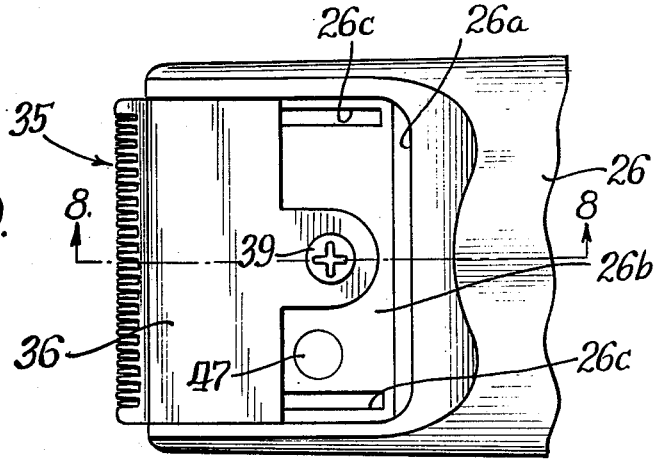
FIG. 10 is an enlarged view of the long hair clipper with the guard removed.

Mounted on the head frame 26 on a portion extending outwardly from the end of the shaving head 12, there is a long hair clipper or trimmer 35. The clipper 35 includes an upper fixed comb 36 which is mounted in shearing engagement with a lower movable cutter 37. The comb 36 is secured within a recess **26*a* in head frame 26 against a flat ledge 26*b* by means of an assembly screw 39. The comb 36 is formed with a row of teeth 36*a* on the edge thereof which projects outwardly of the recess 26*a*. Immediately beneath the comb 36 and clamped against the head frame 26 thereby is a cutter biasing spring 40 as best shown in FIG. 8. The cutter biasing spring 40 engages the cutter 37 midway between its forwardly located cutting teeth 37*a* and a rearwardly extending bearing portion 37*b*. The cutter 37 has a central channel-shaped portion 37*c* located between the teeth 37*a* and the bearing portion 37*b*. This channel-shaped portion engages the inner wall of the head frame at its forward edge while its rearward edge engages a pair of ribs 38, one of which is shown in FIG. 8. In this manner, the cutter 37** is supported for reciprocating movement.

To appreciate the manner in which the cutter 37 is driven in reciprocating engagement with the comb 36, it is necessary to consider the shaving head 12 and the manner in which it is driven. The motor 20 drives an eccentric pin 42 mounted on one end of the armature shaft as shown in FIGS. 2 and 4. This eccentric pin is in driving engagement with two connecting rods 43 which in turn drive crank arms 44 connected to the shafts which support the blades 14. Positioned on one of the crank arms 44 is a fork 45 which moves in an oscillatory manner as the motor 20 drives the connecting rods 43 and the crank arms 44.

In order to drive the cutter 37 from the fork 45, a pivotally mounted lever 46 is mounted on a pin 47 secured to the head frame 26, with the lever supporting portion extending downwardly as is best shown in FIG. 4. The inner end of the lever 46 is received in the fork 45 while the outer end is formed with a hemispherical driving portion **46*a* which drivingly engages the cutter 37. The support pin 47 for the lever 46 also supports a helical spring 48, as shown in FIG. 4, which exerts a biasing force upwardly against the lever 46 and causes the lever 46 to exert a biasing force against the cutter 37. Thus, the spring 40 as well as the drive lever 46 urge the cutter 37 into shearing engagement with the comb 36. As shown in FIG. 4, it will be noted that the comb 36 and the cooperating cutter 37 project beyond the edge of the casing 18 so that there is sufficient clearance for the clipper 35** to be moved into engagement with long hair to be clipped.

Figure 3:
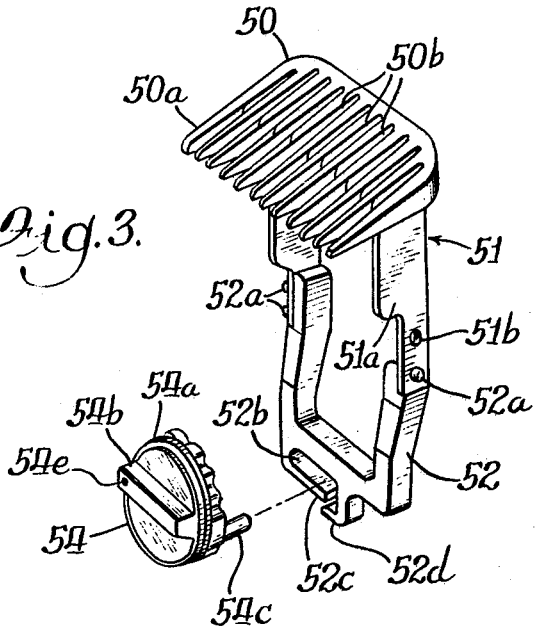
FIG. 3 is an exploded perspective view of the clipper guard and its support and control means used with the shaver of FIG. 1.

Although the clipper 35 is most satisfactory for trimming sideburns and outlining the hair around the ears, it is difficult for a person to do any more extensive trimming of his own hair for the reasons explained more completely above. Because of lack of experience and the limitations in one's dexterity in operating a har trimmer when the only guide is what one sees in the mirror, it is desirable to provide some sort of guide or guard to facilitate the use of the clipper 35 when cutting the hair. In accordance with the instant invention, there is provided a simple adjustable guide means which does not interfere with the operation of the clipper 35 in a retracted position and at the same time is effective in guarding against one damaging the hair when otherwise trimming. This guide means consists of a guard 50 which is of a generally wedge shape, as best shown in FIG. 3, and which has wedge-shaped spaced teeth **50*a* which extend more than half the width of the guard 50, as shown in FIG. 4. Extending in line with the slots formed between the teeth 50*a* are grooves 50*b* which extend almost across the entire rear half of the guard 50**.

As was described above in connection with the clipper 35, the recess **26*a* formed between adjacent walls of the head frame 26 receives the comb 36 on the ledge 26*b* formed at the bottom thereof. This recess 26*a* is of such a shape that the guard 50 in its lowermost position is entirely received therein with its top surface substantially flush with the adjoining walls of the head frame, as is evident from FIG. 1 and FIG. 4. As is also evident from FIGS. 1 and 4, the tips of the teeth of the guard 50 are spaced well back from the teeth of the clipper 35. Thus, when the guard 50 is in its lowermost or retracted position, as shown in FIG. 1 and in solid lines in FIG. 4, the clipper 35 may be used in a normal fashion with the guard 50** being effectively inoperative.

The support means for the guard 50 include an inverted U-shaped member 51 having legs **51*a* which extend downwardly into engagement with a drive yoke 52. The legs 51*a* are substantially parallel to each other and extend normal to the plane of the underside of the guard 50. The head frame 26 is formed with spaced slots 26*c* through which the legs 51*a* extend. Each of the legs 51*a* is formed with holes 51*b* which receive outwardly extending protuberances 52*a* mounted on the yoke 52. The yoke 52 is assembled to the support 51 by merely deflecting the resilient plastic material of the yoke 52 inwardly and snapping the protuberances 52*a* into engagement with the openings 51*b* in the legs 51*a***.

In order to guide the support 51 into yoke 52 for rectilinear movement as the guard 50 is raised or lowered, the housing halves 16 and 17 are formed with grooves 53 which receive the protuberances **52*a* of the yoke 52. With the upper ends of the support legs 51*a* guided by the engagement with the slots 26*a* in the head frame and the lower portons of the legs 51 *a* guided by the slots 53, the guard 54 is supported for controlled movement in a direction normal to the plane of the clipper 35. To further guide the movement of the yoke 52, there are provided integrally molded walls 55 on the case halves 16 and 17. These guides engage the side of the yoke toward the motor 20 while the other side engages the inside wall of housing 18 to restrict the yoke 52** to rectilinear movement.

Manual adjustment of the position of the guard 50 is accomplished by rotating a knob 54 which is mounted in the wall of the casing 18. The casing halves 16 and 17 are formed with semicircular openings which fit together to form a shallow cylindrical recess 56. The knob 54 has an annular rim **54*a* which is received in a peripheral shoulder outwardly of the cylindrical recess 56. In order to retain the knob 54 in position in the cylindrical recess 56, there is provided an elongated metal trim plate 57 which is mounted between the housing halves 16 and 17 with its lengthwise extending edges received in grooves 58 in the housing halves and its upper edge extending beneath the edge of the head frame 26, as is best shown in FIG. 4. The trim plate 57 is formed with an opening 57*a* through which a portion of the knob 54 extends the outer portion being formed with a diametrically extending handle 54*b* which facilitates manual rotation of the knob 54. On its inner face, the knob 54 is provided with an eccentric pin 54*c* which is adapted to engage a transversely extending slot 52*b* in the yoke 52. Thus, as the knob 54 is rotated, the eccentric pin 54*c* engages the slot 52*b* causing the guard 50 to move up or down with respect to the housing 18**.

The slot **52*b* is defined on its lower edge by a flexible wall 52*c* which has a free end. The wall 53*c* is deflected downwardly by the pin 54*c* when the knob 54 is set to position guard 50 in its retracted position. The force applied to the guard 50 through the deflected wall 53*c* tends to hold the guard in its retracted position and eliminate any possible rattling or looseness in the adjustment or control mechanism. Positioned adjacent the end of wall 52*c* is a hooked-shaped projection 52*d* which serves as a stop to prevent excessive deflection of wall 52*c***.

For the purpose of retaining the guard 50 at any one of a number of spaced positions, the knob 54 has mounted thereon a detent member 60, which is best shown in FIGS. 3, 4 and 5. The detent member 60 is formed of a resilient plastic material and extends around more than half the periphery of a portion of the knob 54. The periphery of the knob 54 is formed with a plurality of notches **54*d* into which the ends of the detent member 60 extend. The notches 54*d* are spaced so that the rounded ends of the detent member 60 will always engage two of the notches at the same time. Formed on the outer edge of the detent member 60 is a keying position 60*a* which engages a slot in the front housing half 17 and prevents the detent member 60 from rotating as the knob 54 is rotated. Thus, the knob may be rotated to obtain four selected positions of the guard 50, as shown by the dotted lines in FIG. 4, and in each of these positions, the detent member 60 will engage the notches 54*d* and retain the guard 50 in the selected positon. The handle 54*b* permits the knob 54 to be easily rotated. Positioned on one end of the handle 54*b* is an index mark 54*e* which is designed to be associated with indicia 57*b* on the trim plate 57. This permits the operator to select a position of the guard 50** which has been determined to be suitable for certain types of trimming opertions.

To understand the manner in which the clipper 35 and the guard 50 are used, reference may be had to FIGS. 6 and 7. As has been explained above in connection with the trimming of sideburns and the like, the guard 50 is positioned in its lowermost position where it is effectively recessed beneath the walls of the head frame 26 and provides no obstruction to the access to the clipper 35. However, when it is desired to trim long hair and avoid the possibility of the trimmer or clipper 35 cutting gashes or deep holes into the long hair, the guard 50 is raised to an appropriate height depending upon the minimum length of the hair which one desires left. The trimmer is then used in the manner shown in FIGS. 6 and 7 wherein the guard 50 acts as sort of a runner as the clipper is moved into engagement with the beard or mustache. The teeth 50*a* are of sufficient length that the clipper 35 extends well in advance of the roots between the teeth 50*a* so that the guard 50 has no tendency to deflect the hair in advance of the clipper 35.

For controlling the energization of the motor 20, there is provided a switch 61 which includes a slidable button 61*a*. Mounted in opposed grooves in the housing halves 16 and 17 is a switch operating member 62 having a plate portion 62*a* which is supported for sliding movement in the grooves in the housing halves. The plate portion 62*a* is also formed with an opening 62 which receives the switch button 61*a*, as is clearly shown in FIG. 4. The switch operator 62 has an outwardly extending portion 62*c* which protrudes through the trim plate 57 and may be moved manually to the switch on or switch off position. At the lower end of the housing 18, there is provided an opening 64 which is intended to receive the plug end of a conventional power cord. Mounted within the opening 64 are terminal pins 65 which are supported on an insulating plate 66 mounted in opposed slots in the housing halves 16 and 17. Suitable conductors interconnect the terminal pins 65 to the motor 20 through switch 61. Thus, when the power cord is connected to the terminals 65, the motor 20 may be energized by operating the switch 61. The motor in turn drives both the close shaving head 12 as well as the trimmer 35 with its associated guard 50.

During the normal close shaving of the face, the head 12 is utilized with the guard 50 positioned in its retracted position as shown in FIGS. 1 and 4. If, in performing the close shaving operation any long hairs are noted which are not easily picked up by the openings in the comb 13, it is relatively simple to direct these hairs into the teeth of the clipper 35. When it is desired to trim hairs so that it trims relatively long as in trimming mustaches, beards, sideburns or the fringes of the hair on the head, the guard 50 may be elevated to the selected position by rotating the knob 54. During all these shaving or clipping operations, the shaver is held in the hand by gripping the lower half of the housing as shown in FIGS. 1 and 4. This portion of the housing is tapered to make it easy and convenient to grip. It should also be noted that the center line of the gripping portion of the housing extends at a slight angle to the upper surface of the shaving head 12 rather than being positioned normal to that surface. It is also noted that the plane of the trimmer 35 also is disposed at a similar angle to the center line of the clipper portion of the housing 18. Thus, whether the shaver is used for close shaving or trimming, the alternately usable head 12 and clipper 35 are disposed to be conveniently used while gripping the housing 18 in substantially the same manner. This angled disposition of the handle also permits the housing to be angled back sharply from the cutting teeth on the clipper 35 so that the housing will not engage or interfere with long hair being trimmed.

While there has been shown and described a particular embodiment of the present invention, it will be apparent to those skilled in the art that various changes and modifications may be made without departing from the invention in its broader aspects, and its is, therefore, contemplated in the appended claims to cover all such changes and modifications as fall within the true spirit and scope of the present invention.

What is claimed as new and desired to be secured by Letters Patent of the United States is:

1. An electric dry shaver comprising a casing supporting thereon a shaving head and a long hair clipper, a motor in said casing driving said shaving head and said clipper, said clipper including a comb plate having a row of teeth formed on one edge thereof and secured rigidly to said casing, a cutter mounted within said housing for reciprocating movement and having a row of teeth formed on one edge thereof biased into shearing engagement with said comb teeth, said housing being formed with a recess above said comb, a movable guard received in said recess and having elongated teeth extending parallel to the surface of said comb and terminating adjacent said comb teeth, support legs on the lateral edges of said guard extending through slots in said housing, control means in said casing for raising and lowering said guard in a direction normal to said comb, said housing having means formed on the interior thereof to guide said guard in its movement normal to said comb, rotatable control means mounted on said housing having a manually operable portion outside of said housing and extending into the interior of said housing, an eccentric on said control means connected to said support legs through a yoke member to raise and lower said guard upon rotation of said control means.

2. A long hair clipper for trimming hair close to the skin and for trimming hair at selected lengths comprising a blade set including a comb fixed with respect to a housing and a cutter, said comb and cutter each having a row of teeth formed along one edge thereof, a motor drivingly connected to said cutter for reciprocating said cutter with said teeth on said cutter in shearing engagement with the teeth on said comb, said comb being a flat plate mounted on a recessed surface on said housing with said cutter positioned between said comb and the housing, a wedge-shaped guard member having a grooved outer face and a flat inner face adapted to lie flat against said comb, said guard member having a thin edge tapering to a thick edge, slots in said guard member extending from said thin edge toward said thick edge forming pointed teeth which extend substantially to the middle of said guard member, said housing defining a wedge-shaped recess within which said comb is mounted, said recess being shaped to receive said guard member in its lowermost position flat against said comb, the walls of said housing defining said recess being substantially flush with outer surface of said guard member in said lowermost position, and support means carried by said guard member extending into said housing to selectively position said guard member at any of a number of elevated positions spaced from said comb, said support means including support legs which extend normal to said comb through slots in said housing which slots guide said legs for lengthwise movement.

3. The long hair clipper of claim 2 including a close shaving head disposed on said housing adjacent to said clipper comb and cutter, said head including oscillating blade supporting shafts driven by said motor, a lever mounted on said housing drivingly interconnecting one of said shafts and said cutter, said housing being formed with a tapered handle portion disposed at an angle to said close shaving head and at a corresponding angle to the plane defined by said comb plate.

4. A long hair clipper for trimming hair close to the skin and for trimming hair at selected lengths comprising a blade set including a comb fixed with respect to a housing and a cutter, said comb and cutter each having a row of teeth formed along one edge thereof, a motor drivingly connected to said cutter for reciprocating said cutter with said teeth on said cutter in shearing engagement with the teeth on said comb, said comb being a flat plate mounted on a recessed surface on said housing with said cutter positioned between said comb and the housing, a wedge-shaped guard member having a grooved outer face and a flat inner face adapted to lie flat against said comb, said guard member having a thin edge tapering to a thick edge, slots in said guard extending from said thin edge toward said thick edge forming pointed teeth which extend substantially to the middle of said guard member, and support means carried by said guard member extending into said housing to selectively position said guard member at any of a number of elevated positions spaced from said comb, said support means including support legs which extend normal to said comb through slots in said housing which slots guide said legs for lengthwise movement, said support means including a U-shaped yoke having legs the ends of which are connected to the free ends of said support legs, means in said housing guiding said yoke for rectilinear movement parallel to the length of said legs, manually rotatable control means on said housing wall extending into engagement with said yoke, said yoke including a slot engaged by an eccentric on said control means whereby rotation of said control means raises and lowers said guard members.

5. The long hair clipper of claim 4 wherein said rotatable control means is provided with a detent to retain said control means and said yoke in any one of a number of selected positions, the portion of said yoke defining said slot being resilient and deflectable by said eccentric whereby said rotatable control means applies a downward biasing force against said guard member in its lowermost position against said comb.

6. An electric dry shaver of the type having a shaving head and a long hair trimmer comprising an elongated housing having a shaving section mounted at one end thereof with a hand grip portion extending downwardly from said shaving section, said shaving section including a head frame supporting a pair of arched perforated combs and cooperating cutters mounted for shearing enagagement with the underside of said combs, a fixed long hair trimmer disposed on said head frame adjacent said combs and having shearing teeth along one edge thereof, said combs having a shaving surface facing away from the direction in which said handle extends, said trimmer having a guard which is movable between a retracted position against said trimmer and a plurality of elevated positions spaced above said trimmer, said head frame being provided with walls surrounding said trimmer and leaving only said shearing teeth exposed, said guard in its retracted position being substantially received within the recess formed by said walls, said guard being supported by space legs which extend through slots in said head frame, means in said housing hand grip portion connected to said legs and controlled by manually operable means external to said housing to raise and lower said guard, detent means to retain said guard in any one of a number of selected positions, said manually operable means comprises a knob having a cylindrical portion mounted in an opening formed in said housing, said detent including a resilient C-shaped member engaging notches in said cylindrical portion and being keyed to said housing to provide a detent action as said knob is rotated.

7. In an electric shaver having a trimmer, the improvement comprising a housing shaving head and a trimmer mounted thereon; a motor in said housing drivingly connected to said shaving head and trimmer; a movable trimmer guard mounted on said housing; a control knob on said housing; means interconnecting said guard and said knob whereby said knob is rotatable to adjust said trimmer guard; said knob having an outer manual control portion, a peripheral mounting flange and an inwardly directed cylindrical portion; an opening in said housing in which said knob is mounted for rotation; said opening having an annular shoulder against which said flange is received with the outermost surface of said flange being flush with the outer surface of said housing; and an escutcheon plate shaped to lie flat against and secured to the outer surface of said housing; said plate overlying said flange to retain said knob with respect to said housing.

8. The shaver of claim 7 wherein said opening is formed with a semi-cylindrical wall portion which engages a first portion of the cylindrical portion of said knob, the remainder of the cylindrical portion of said knob being embraced by a C-shaped detent means, said detent means being resilient and having ends which engage spaced notches in said cylindrical portion of said knob.

9. The shaver of claim 8 wherein said knob is provided with a pin extending parallel but spaced from the axis of rotation of said knob, a drive yoke connected to said trimmer guard within said housing, said yoke having a slot engaged by said pin whereby rotation of said knob raises and lowers said guard.

* * * * *